US007070302B2

(12) United States Patent
Lin

(10) Patent No.: US 7,070,302 B2
(45) Date of Patent: Jul. 4, 2006

(54) ORNAMENTAL LIGHTING ASSEMBLY

(76) Inventor: Vincent Lin, No. 39, Sec. 3, Chung-Hua Rd., Hsin-Chu City (TW)

( * ) Notice: Subject to any disclaimer, the term of this patent is extended or adjusted under 35 U.S.C. 154(b) by 258 days.

(21) Appl. No.: 10/831,433

(22) Filed: Apr. 23, 2004

(65) Prior Publication Data

US 2005/0018425 A1 Jan. 27, 2005

Related U.S. Application Data

(63) Continuation-in-part of application No. 10/270,947, filed on Oct. 15, 2002, now abandoned.

(51) Int. Cl.
*F21S 13/14* (2006.01)

(52) U.S. Cl. ..... 362/252; 362/806; 439/123; 439/447

(58) Field of Classification Search ..... 362/227, 362/249, 252, 806, 810; 439/123, 447
See application file for complete search history.

(56) References Cited

U.S. PATENT DOCUMENTS 2,506,620 A * 5/1950 Sundt ..... 362/249
6,367,952 B1 * 4/2002 Gibboney, Jr. ..... 362/249
6,485,161 B1 * 11/2002 Whitaker et al. ..... 362/249

* cited by examiner

*Primary Examiner*—Sandra O'Shea
*Assistant Examiner*—Ismael Negron
(74) *Attorney, Agent, or Firm*—Trop, Pruner & Hu, P.C.

(57) ABSTRACT

An ornamental lighting assembly includes a plurality of lighting units, each of which includes a plurality of upright posts, a plurality of lamps mounted respectively on the posts, hollow upper and lower spacing ribs parallel to each other and extending through the posts, conductive upper and lower wires enclosed respectively in the upper and lower spacing ribs, and pairs of conductive connecting wires connected electrically to the lamps and the upper and lower wires. Each of the upper and lower spacing ribs is non-foldable and non-collapsible so that the spacing between two adjacent ones of the posts is fixed, and is slightly flexible so as to enable the lighting units to be assembled into a circle.

1 Claim, 4 Drawing Sheets

ORNAMENTAL LIGHTING ASSEMBLY

CROSS-REFERENCE TO RELATED APPLICATION

This application is a continuation-in-part (CIP) of U.S. patent application Ser. No. 10/270,947, filed by the applicant on Oct. 15, 2002, now abandoned the entire disclosure of which is incorporated herein by reference.

BACKGROUND OF THE INVENTION

1. Field of the Invention

This invention relates to an ornamental lighting assembly for ornamental use.

2. Description of the Related Art

Conventional ornamental lighting units normally include a long conductive power cord with a plurality of light bulbs connected thereto. However, the conventional ornamental lighting units can not be reassembled into a desired shape according to the user's requirements.

U.S. Pat. No. 6,367,952 discloses a lighting unit including a string of lights that has a plurality of sockets and a plurality of lamps mounted respectively on the sockets and connected electrically to each other through a number of wires. Since the wires are foldable and are collapsible, arrangement of the lights along a straight line, a circle, or any other shape is relatively difficult, inconvenient, and time-consuming, and the spacing between two adjacent ones of the lights is difficult to control.

SUMMARY OF THE INVENTION

Therefore, it is an object of the present invention to provide an ornamental lighting assembly that is capable of overcoming the aforesaid drawbacks of the conventional lighting unit.

According to the present invention, there is provided an ornamental lighting assembly that comprises a plurality of lighting units, each of which includes a plurality of upright posts aligned in a horizontal direction, a plurality of lamps mounted respectively on the posts, hollow upper and lower spacing ribs parallel to each other and fixed to and extending in the horizontal direction through the posts, conductive upper and lower wires enclosed respectively in the upper and lower spacing ribs, and pairs of conductive connecting wires. Each of the pairs of the conductive connecting wires is received in a respective one of the posts, and is connected electrically to a respective one of the lamps and the upper and lower wires. Each of the upper and lower spacing ribs has opposite complementary left and right connecting ends. Each of the upper and lower wires extends from the left connecting end to the right connecting end of the respective one of the upper and lower spacing ribs. The left connecting end of each of the upper and lower spacing ribs is formed with a conductive engaging tongue that is electrically connected to the respective one of the upper and lower wires. The right connecting end of each of the upper and lower spacing ribs is formed with an engaging groove. Each of the upper and lower wires extends through the engaging groove in the right connecting end of the respective one of the upper and lower spacing ribs. The engaging tongue of the left connecting end of each of the upper and lower spacing ribs of each of the lighting units is snugly fitted into the engaging groove in the right connecting end of a respective one of the upper and lower spacing ribs of an adjacent one of the lighting units to connect electrically with a respective one of the upper and lower wires of the adjacent one of the lighting units. Each of the upper and lower spacing ribs of each of the lighting units is non-foldable and non-collapsible so that the spacing between two adjacent ones of the posts is fixed, and is slightly flexible so as to enable the lighting units to be assembled into a circle.

BRIEF DESCRIPTION OF THE DRAWINGS

In drawings which illustrate an embodiment of the invention.

DETAILED DESCRIPTION OF THE PREFERRED EMBODIMENT

Figure 1:
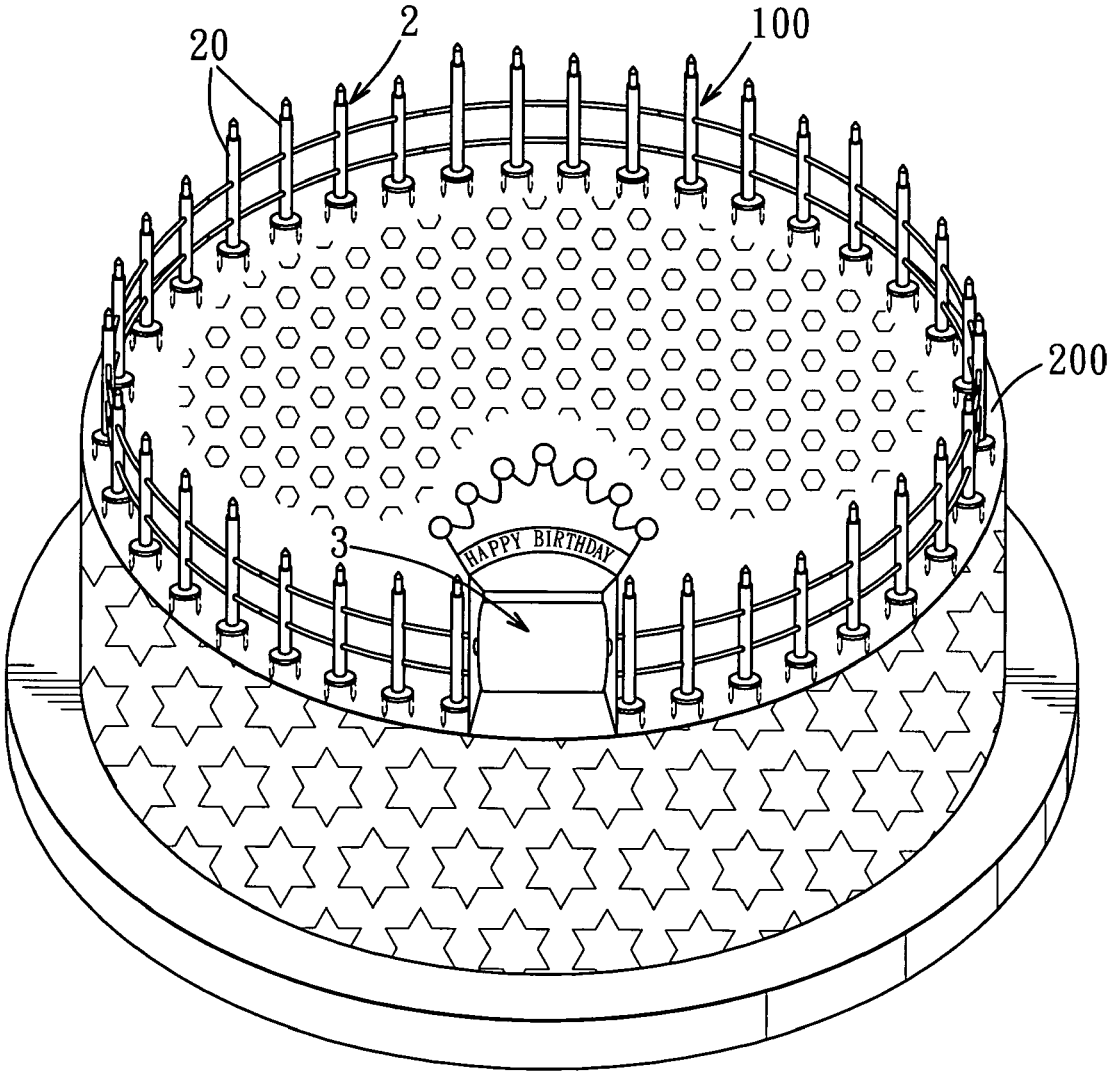
FIG. 1 is a perspective view of the preferred embodiment of an ornamental lighting assembly according to the present invention, which can be assembled into a circular shape for mounting on a birthday cake.
Figure 2:
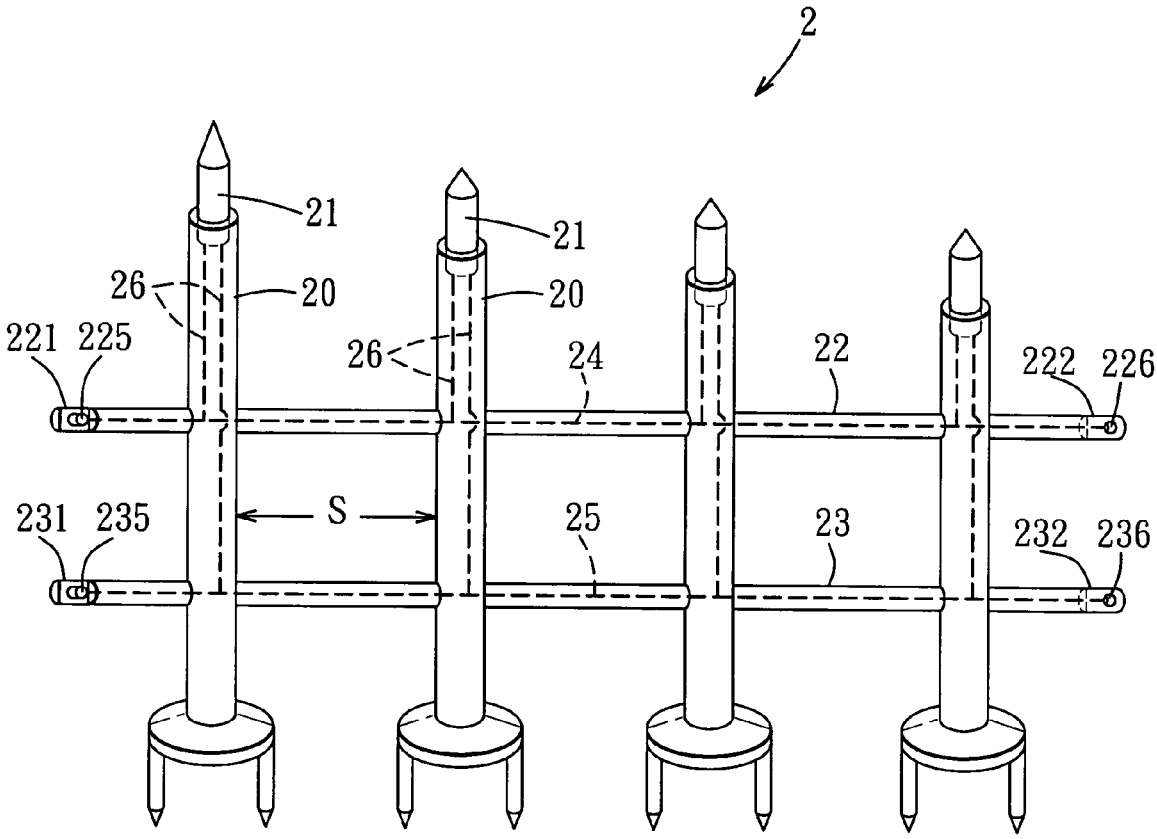
FIG. 2 is a perspective view of a lighting unit of the ornamental lighting assembly of the preferred embodiment.
Figure 3:
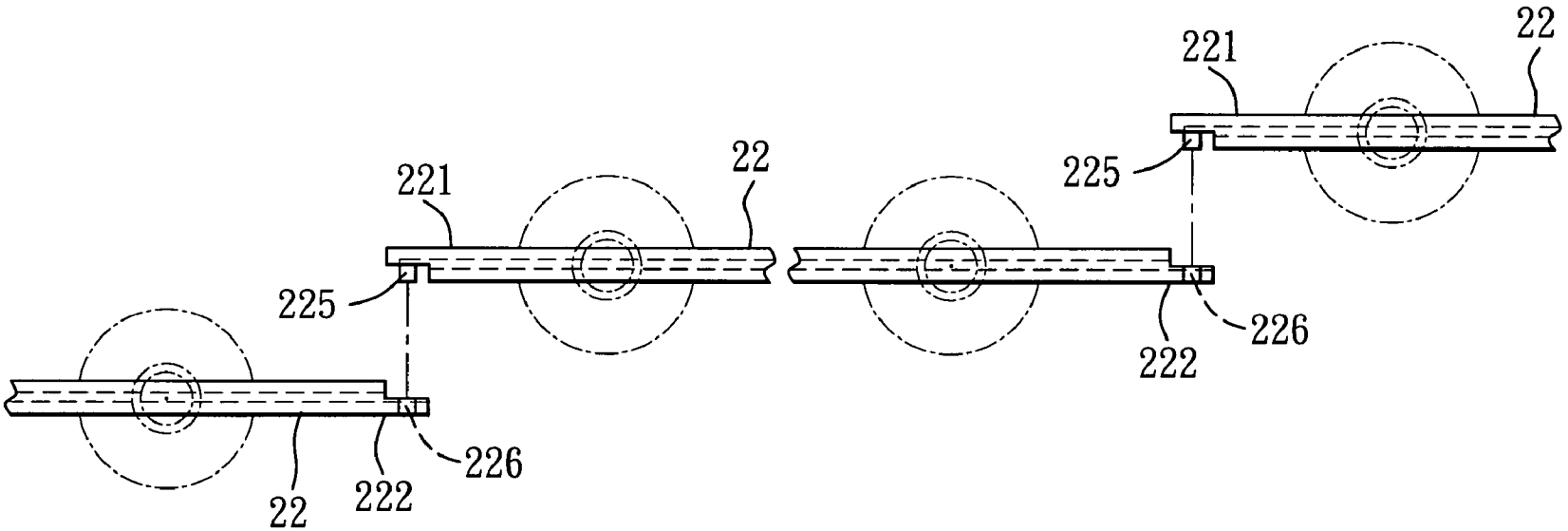
FIG. 3 is a fragmentary schematic top view to illustrate how a conductive wire of a lighting unit is connected to a conductive wire of an adjacent lighting unit of the preferred embodiment.
Figure 4:
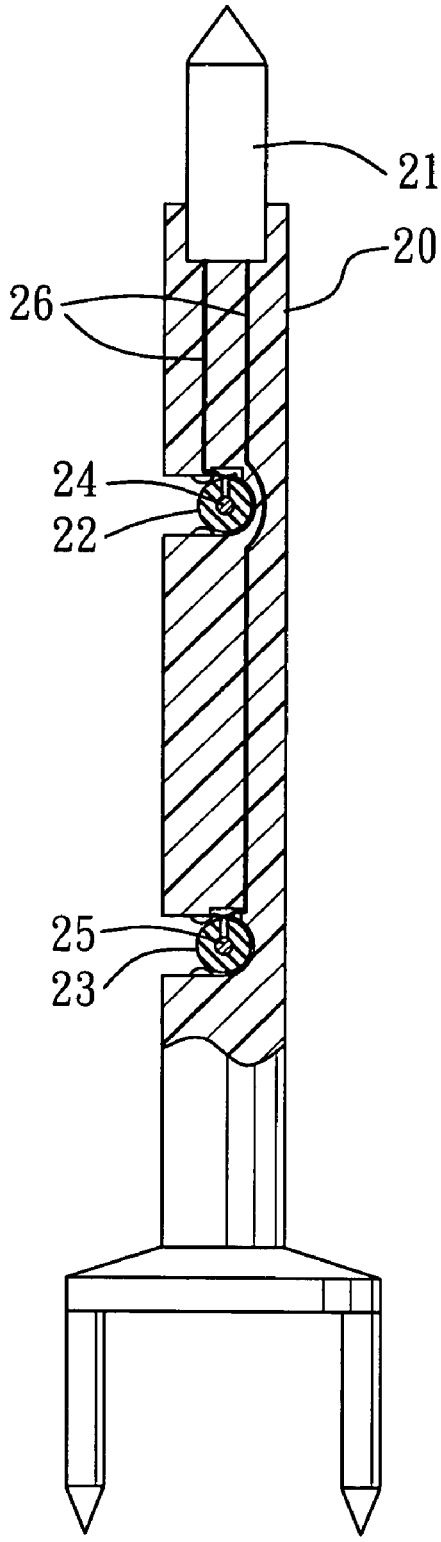
FIG. 4 is a sectional view to illustrate how a pair of conductive connecting wires are connected electrically to a lamp and upper and lower wires of a lighting unit of the preferred embodiment.

FIGS. 1 to 4 illustrate the preferred embodiment of an ornamental lighting assembly 100 according to this invention for ornamenting objects, such as a birthday cake 200.

The ornamental lighting assembly 100 includes a plurality of lighting units 2, each of which includes a plurality of upright posts 20 aligned in a horizontal direction, a plurality of lamps 21 mounted respectively on the posts 20, hollow upper and lower spacing ribs 22, 23 parallel to each other and fixed to and extending in the horizontal direction through the posts 20, conductive upper and lower wires 24, 25 enclosed respectively in the upper and lower spacing ribs 22, 23, and pairs of conductive connecting wires 26. Each of the pairs of the conductive connecting wires 26 is received in a respective one of the posts 20, and is connected electrically to a respective one of the lamps 21 and the upper and lower wires 24, 25. Each of the upper and lower spacing ribs 22, 23 has opposite complementary left and right connecting ends 221, 222 (231, 232). Each of the upper and lower wires 24, 25 extends from the left connecting end 221 (231) to the right connecting end 222 (232) of the respective one of the upper and lower spacing ribs 22, 23. The left connecting end 221 (231) of each of the upper and lower spacing ribs 22, 23 is formed with a conductive engaging tongue 225 (235) that is electrically connected to the respective one of the upper and lower wires 24 (25). The right connecting end 222 (232) of each of the upper and lower spacing ribs 22, 23 is formed with an engaging groove 226 (236). Each of the upper and lower wires 24, 25 extends through the engaging groove 226 (236) in the right connecting end 222 (232) of the respective one of the upper and lower spacing ribs 22 (23). The engaging tongue 225 (235) of the left connecting end 222 (232) of each of the upper and lower spacing ribs 22, 23 of each of the lighting units 2 is snugly fitted into the engaging groove 226 (236) in the right connecting end 222 (232) of a respective one of the upper and lower spacing ribs 22, 23 of an adjacent one of the lighting units 2 to connect electrically with a respective one of the upper and lower wires 24, 25 of the adjacent one of the lighting units 2. Each of the upper and lower spacing ribs 22, 23 of each of the lighting units 2 is non-foldable and non-collapsible so that the spacing (S) between two adjacent ones of the posts 20 is fixed, and is slightly flexible so as to enable the lighting units 2 to be assembled into a circle (see FIG. 1). The lighting units 2 can be powered using a battery 3, or can be connected electrically to a plug (not show) for connecting to a power source.

Since the upper and lower spacing ribs 22, 23 of each lighting unit 2 of the ornamental lighting assembly of this invention is non-foldable and non-collapsible, the lighting units 2 can be assembled into a desired shape according to the user's requirements.

With the invention thus explained, it is apparent that various modifications can be made without departing from the spirit of the present invention. It is therefore intended that the invention be limited only as recited in the appended claims.

I claim:

1. An ornamental lighting assembly comprising:

a plurality of lighting units, each of which includes a plurality of upright posts aligned in a horizontal direction, a plurality of lamps mounted respectively on said posts, hollow upper and lower spacing ribs parallel to each other and fixed to and extending in said horizontal direction through said posts, conductive upper and lower wires enclosed respectively in said upper and lower spacing ribs, and pairs of conductive connecting wires, each of said pairs of said conductive connecting wires being received in a respective one of said posts and being connected electrically to a respective one of said lamps and said upper and lower wires, each of said upper and lower spacing ribs having opposite complementary left and right connecting ends, each of said upper and lower wires extending from said left connecting end to said right connecting end of the respective one of said upper and lower spacing ribs, said left connecting end of each of said upper and lower spacing ribs being formed with a conductive engaging tongue that is electrically connected to the respective one of said upper and lower wires, said right connecting end of each of said upper and lower spacing ribs being formed with an engaging groove, each of said upper and lower wires extending through said engaging groove in said right connecting end of the respective one of said upper and lower spacing ribs, said engaging tongue of said left connecting end of each of said upper and lower spacing ribs of each of said lighting units being snugly fitted into said engaging groove in said right connecting end of a respective one of said upper and lower spacing ribs of an adjacent one of said lighting units to connect electrically with a respective one of said upper and lower wires of said adjacent one of said lighting units;

wherein each of said upper and lower spacing ribs of each of said lighting units is non-foldable and non-collapsible so that the spacing between two adjacent ones of said posts is fixed, and is slightly flexible so as to enable said lighting units to be assembled into a circle.

* * * * *